United States Patent [19]

Carmichael et al.

[11] Patent Number: 4,830,089

[45] Date of Patent: May 16, 1989

[54] METHOD AND APPARATUS FOR SETTING PRECISE NOZZLE/BELT AND NOZZLE/EDGE DAM BLOCK GAPS

[75] Inventors: Robert J. Carmichael, Colchester; Charles D. Dykes, Milton, both of Vt.; Ronald Woodrow, Saltsburgh, Pa.

[73] Assignees: Hazelett Strip-Casting Corporation, Malletts Bay, Colchester, Vt.; USX Corporation, Pittsburgh, Pa.

[21] Appl. No.: 190,585

[22] Filed: May 5, 1988

[51] Int. Cl.[4] ..... B22D 11/06; B22D 11/10

[52] U.S. Cl. ..... 164/481; 29/271; 29/466; 164/137; 164/431; 164/439

[58] Field of Search ..... 164/481, 483, 488, 489, 164/490, 137, 431, 432, 438, 439, 440; 29/271, 466

[56] References Cited

U.S. PATENT DOCUMENTS

| | | | |
|---|---|---|---|
| 3,757,405 | 9/1973 | Kurth et al. | 164/489 X |
| 3,945,425 | 3/1976 | Foye | 164/137 |
| 4,454,907 | 6/1984 | Flowers | 164/440 X |
| 4,576,218 | 3/1986 | Artz et al. | 164/431 |

FOREIGN PATENT DOCUMENTS

| | | | |
|---|---|---|---|
| 60-137556 | 7/1985 | Japan | 164/440 |
| 61-229449 | 10/1986 | Japan | 164/438 |
| 61-296944 | 12/1986 | Japan | 164/481 |
| 62-203645 | 9/1987 | Japan | 164/439 |

*Primary Examiner*—Nicholas P. Godici
*Assistant Examiner*—J. Reed Batten, Jr.
*Attorney, Agent, or Firm*—Parmelee, Bollinger & Bramblett

[57] ABSTRACT

A pair of guide pins are mounted on sideplate extensions of the caster and mating roller pairs are mounted on the nozzle assembly. The nozzle is advanced toward the caster so that the roller pairs engage the guide pins. Both guide pins are remotely adjustable in the vertical direction by hydraulic cylinders acting through eccentrics. This moves the nozzle vertically. The guide pin on the inboard side of the caster is similarly horizontally adjustable. The nozzle roller pair which engage the inboard guide pin are flanged so that the nozzle moves horizontally with the inboard guide pin.

21 Claims, 7 Drawing Sheets

METHOD AND APPARATUS FOR SETTING PRECISE NOZZLE/BELT AND NOZZLE/EDGE DAM BLOCK GAPS

TECHNICAL FIELD

This invention relates to the field of continuous casting of metal. More particularly, it pertains to the introduction of molten metal to a continuous caster and to the precise alignment of the molten metal nozzle in the caster inlet.

BACKGROUND ART

Continuous twin-belt casting machines are well known in the art. These machines include a pair of travelling flexible metal belts slightly downwardly inclined in the direction of travel. One belt defines the upper surface, and the other the lower surface, of an elongated mold chamber or cavity having a downstream exit for the cast product. The sides of the mold chamber are defined by traveling edge dams which move with the belts. The belts are normally carried by rollers which are cantilevered outwardly from an "inboard" frame. This leaves the outboard side relatively open, permitting the belts to be readily removed and replaced as desired. Examples of continuous casting machines are described in the following U.S. Pats.: 3,036,348; 3,041,686; 3,167,830; and 3,848,658.

Molten metal is supplied to the inlet end of the casting machine from a tundish which may be mounted on a car, through a feed tube, and a nozzle assembly. The nozzle itself is ceramic. Close tolerances are required between the nozzle and the inlet end of the mold cavity as defined by the upper and lower belts and the side dams. Normally, the tundish and the feed tube and nozzle assembly are preheated in a retracted position. They are then mated to the caster moments before casting begins.

U.S. Pat. No. 4,544,018, issued Oct. 1, 1985 to Figge et al., discloses one arrangement for interconnecting the tundish with a feeding trunk while positioning the nozzle. However, one problem with a feeding device such as that of the Figge et al. patent is that the alignment of the various members, including that between the nozzle and the caster inlet, is difficult to control. This control difficulty arises because the control points are remote from the nozzle. This alignment control difficulty is also disadvantageous because repeatability between castings is not assured and clearance control is difficult as a result of movement created by thermal expansion and contraction and metal transfer.

Accordingly, it is a primary object of the present invention to provide an improved locating and guiding system between the nozzle assembly and the caster inlet.

Another object is to reference the nozzle assembly directly to the caster carriage rather than from a remote location as in the prior art.

Other objects, features, and advantages will become apparent from the following description and appended claims.

SUMMARY OF INVENTION

The objects of this invention are achieved by means of two pairs of mating guide members, one male and one female. One pair of guide members is integral with the caster carriage. The other pair is mounted on the nozzle assembly. The guide members of at least one pair are remotely adjustable, both vertically and horizontally, by means of hydraulic cylinders and mechanical eccentrics.

BRIEF DESCRIPTION OF DRAWINGS

The invention is described, by way of example, with reference to the following drawings.

BEST MODE FOR CARRYING OUT THE INVENTION

Figure 1:
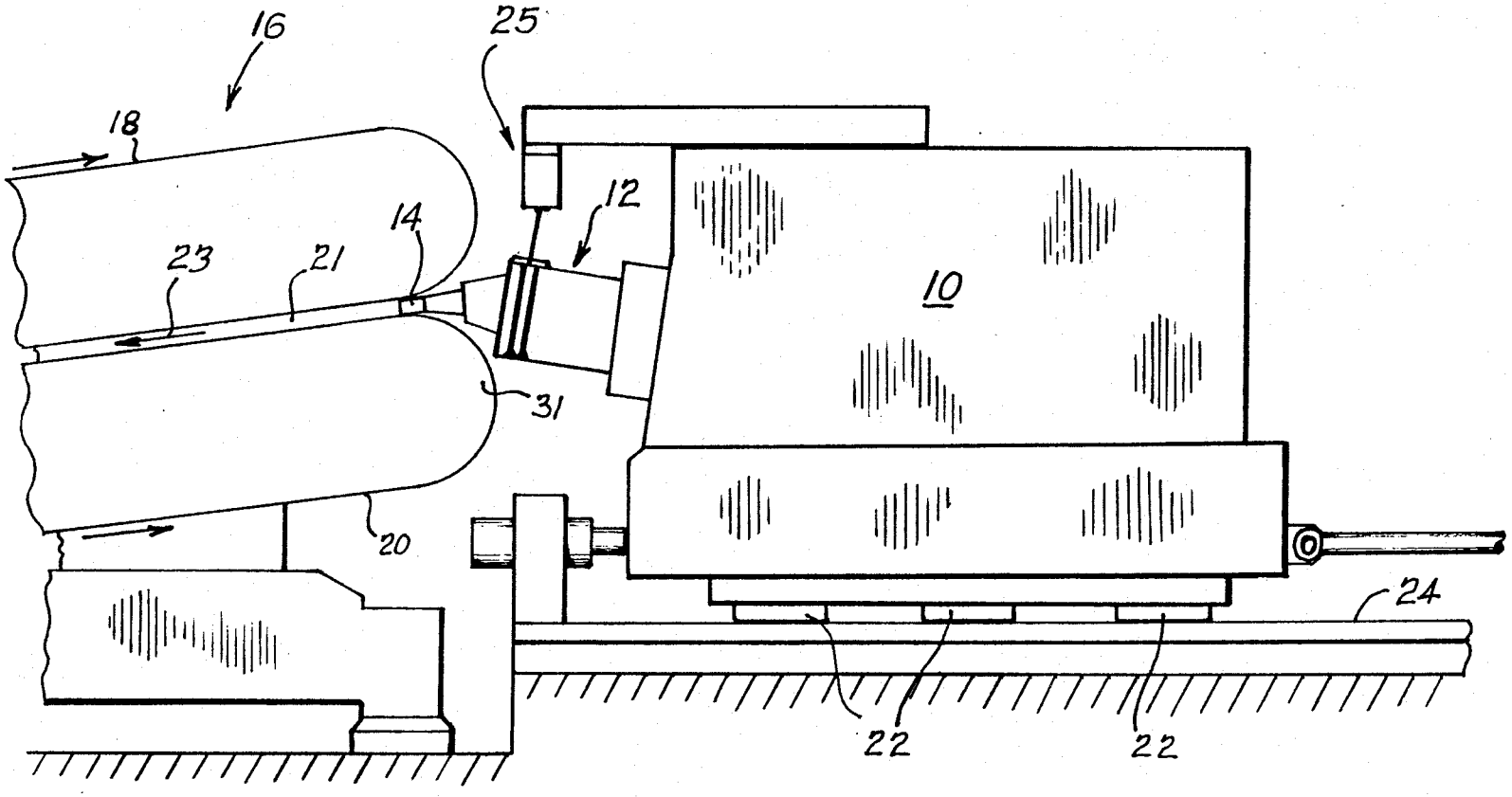
FIG. 1 is a simplified schematic side elevational view illustrating the relationship between a tundish, a feed tube and nozzle assembly, and the inlet end of a metal caster.

Illustrated very schematically in FIG. 1 is a tundish 10 coupled to a feed tube and nozzle assembly 12 for positioning a nozzle 14 in the inlet of a continuous caster 16 which includes an upper belt 18 and a lower belt 20 defining a mold cavity 21.

The tundish 10 is horizontally moveable on air bearings 22 on rails 24. The feed tube and nozzle assembly 12 is articulated and is supported by an adjustable support 25 so that the nozzle 14 can be inclined forwardly downwardly to correspond to the downward downstream inclination of caster 16. The downstream casting direction is shown by arrow 23.

Figure 2:
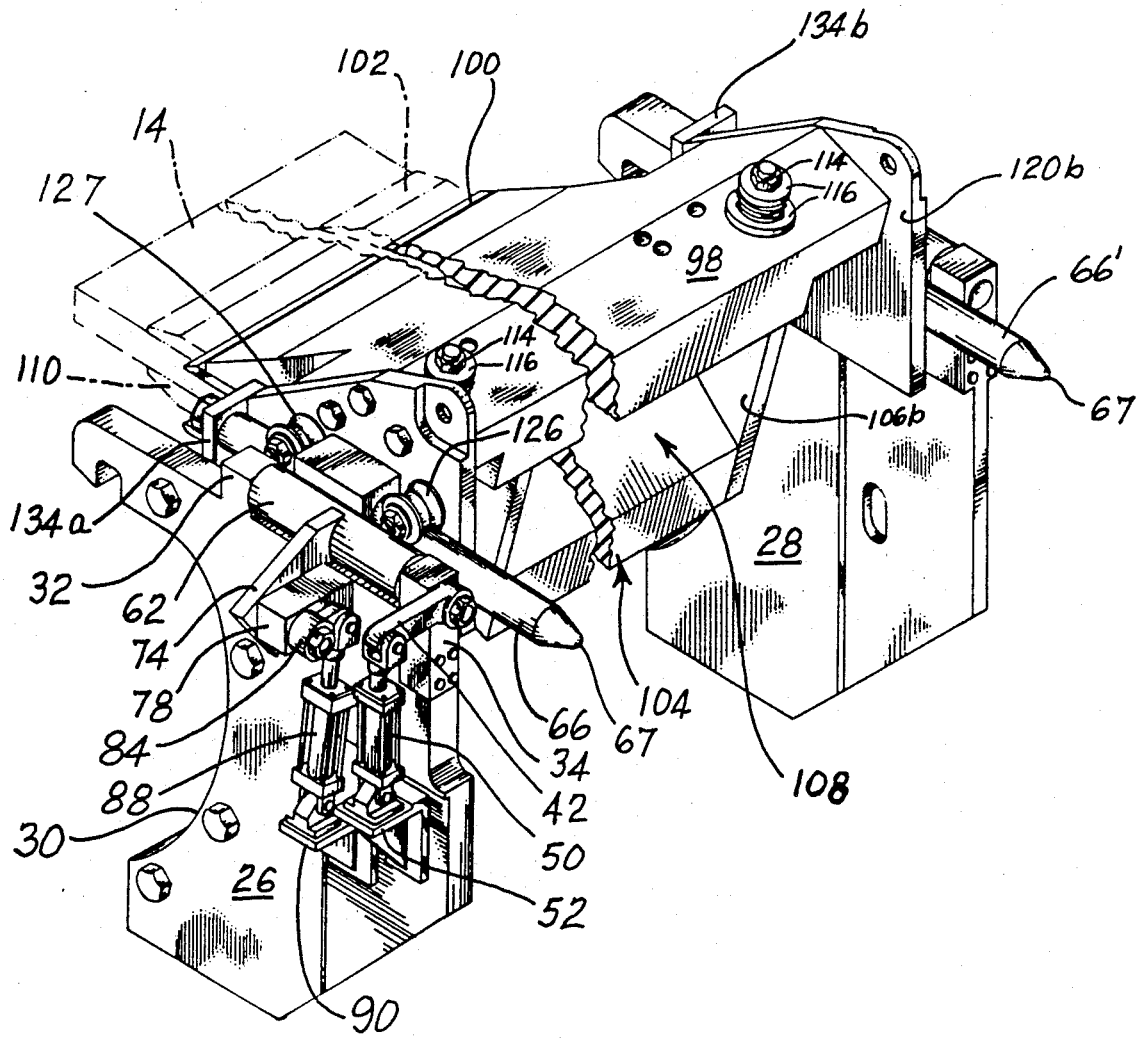
FIG. 2 is a perspective view of a presently preferred embodiment of the invention showing a nozzle assembly positioned in the inlet end of a casting machine, as seen looking generally toward the "inbord" side of the caster.

The basic elements of this invention are illustrated in FIG. 2. In FIG. 2 the left side is the "inboard" side of the caster, and the right side is the "outboard" side. An inboard sideplate extension 26 is bolted to the inboard side of the caster frame (not shown). A substantially similar, but reversed image outboard sideplate extension 28 is bolted to the outboard side of the caster frame. Each of the inboard and outboard sideplate extensions includes a semicircular cutout 30 to accommodate the lower belt 20 and its corresponding entrance roller 31. Extending upwardly from the top edge of each of the sideplate extensions is a downstream bearing block 32. Secured to the front edge of each of the sideplate extensions 26, 28 and extending upwardly in alignment with the downstream bearing block 32 is an upstream bearing block 34.

Figure 3:
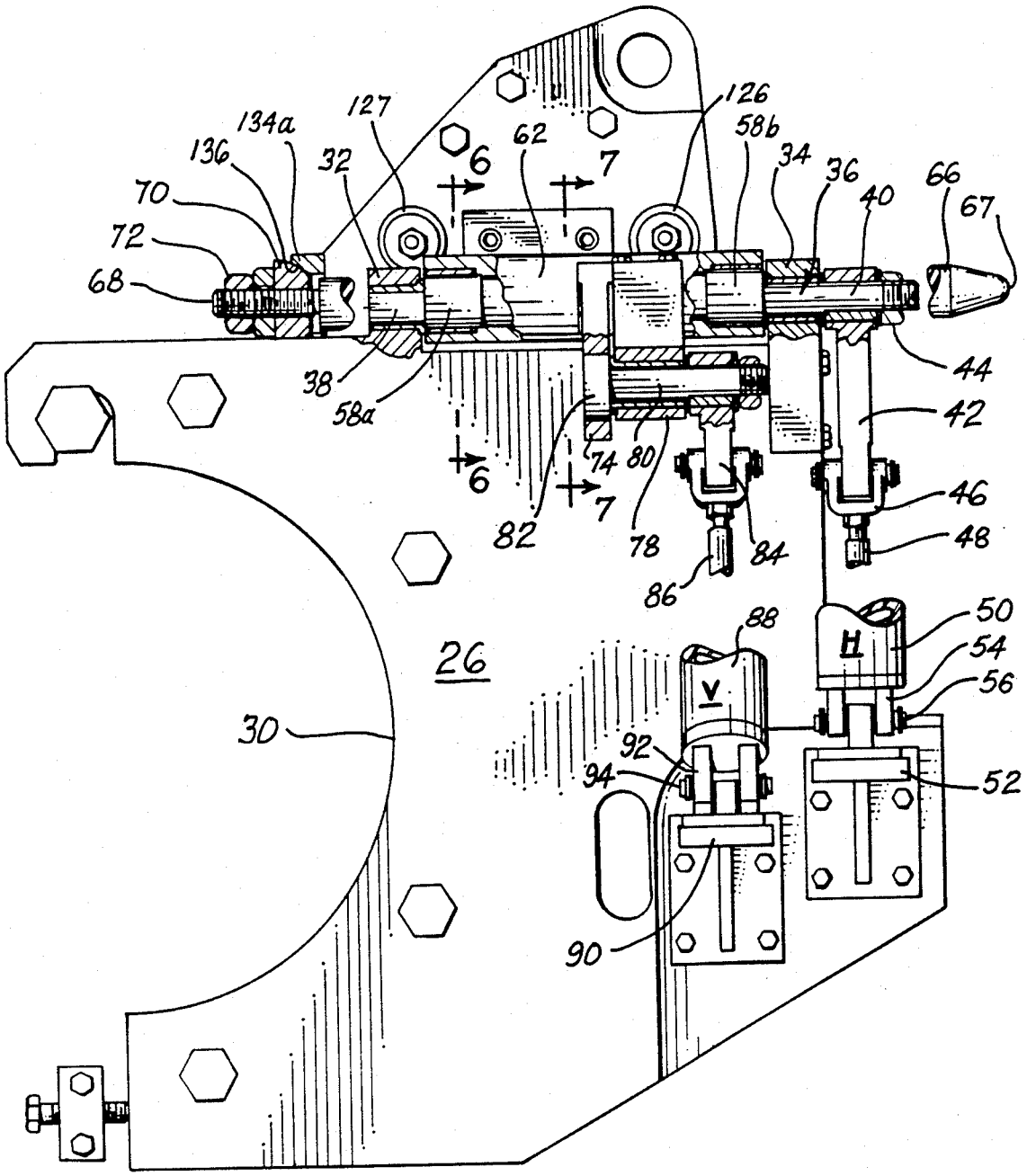
FIG. 3 is a left elevational view ("inboard" side) of the apparatus of FIG. 2, portions thereof being broken away to illustrate its internal construction.

As will be seen in FIG. 3, an eccentric shaft 36 has downstream end 38 and upstream end 40 which are mounted for rotation in sleeve bearings housed in the respective downstream block 32 and upstream bearing block 34. The upstream end 40 extends through and out of the upstream bearing block 34 and is keyed to a substantially horizontal crank arm 42. (For clarity of illustration, the crank arm is shown in FIG. 3 rotated from its actual position in FIG. 2.) The upstream end 40 of eccentric shaft 36 is threaded and crank arm 42 is secured by a nut 44. The end of the crank arm 42 is pivotally connected through a clevis 46 to the piston rod 48 of a lateral adjustment hydraulic cylinder 50. The lower end of this hydraulic cylinder 50 is pivotally mounted to a bracket 52 on the inboard side plate extension 26 by means of a clevis 54 and pin 56.

Returning to FIG. 3, it will be noted that the eccentric shaft 36 includes axially spaced, enlarged cylindrical eccentric portions 58*a*, 58*b*, respectively near the downstream bearing block 32 and the upstream bearing block 34. These eccentric portions 58*a*, 58*b* produce lateral adjustments as will be explained later, being mounted in sleeve bearings 60 (FIG. 6) contained within a follower cylinder 62 which extends between the downstream bearing block 32 and upstream bearing block 34.

Secured to the follower cylinder 62 by means of a radially projecting rib 64 (FIGS. 5, 6, 7) is a cylindrical guide pin 66 which extends parallel to the follower cylinder 62, is tapered to a rounded point 67 at its upstream end, and has a threaded portion 68 (FIG. 3) at its downstream end. Mounted on the threaded portion 68 is a stationary caster stop comprising a conical nut 70 (FIG. 3), a washer 71, followed by a hex nut 72.

Figure 5:
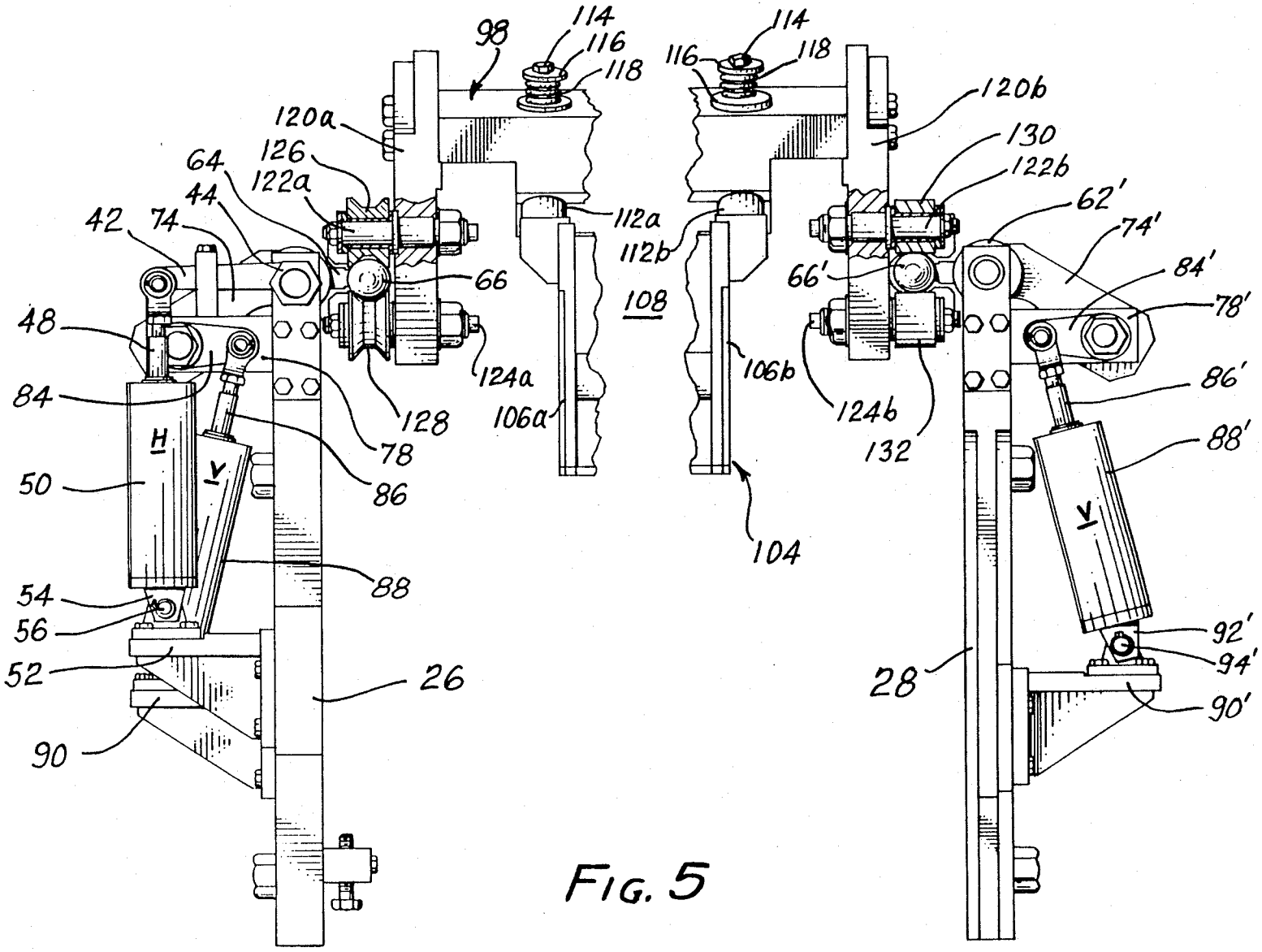
FIG. 5 is a front end view of the apparatus of FIG. 2, portions thereof being broken away to illustrate the internal construction.
Figure 7:
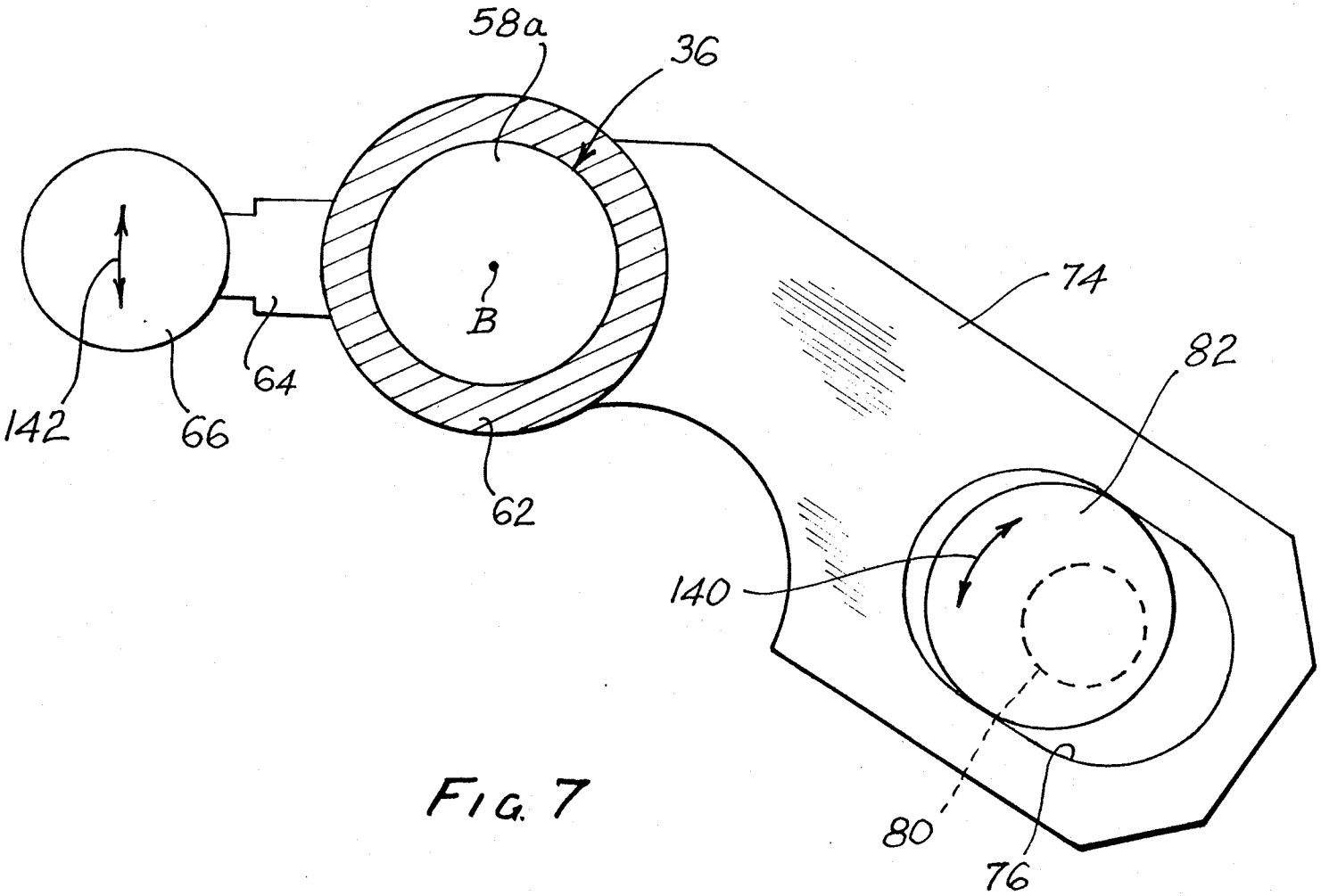
FIG. 7 is an enlarged cross-section taken substantially along the line 7—7 of FIG. 3.

Extending outwardly from the opposite side of the follower cylinder 62, as seen in FIG. 7, is a downwardly angled radius arm 74 which defines a slot 76 (FIG. 7). A block 78 (FIGS. 2, 3 and 5) is fixed on the inboard sideplate extension 26 and extends outwardly adjacent the radius arm 74. A rotatable vertical adjustment shaft 80 (FIG. 7) extends through a sleeve bearing in the fixed block 78 and terminates in an eccentric 82 carried within the slot 76. The opposite end of the shaft 80 is keyed to one end of a crank 84 (FIGS. 2, 3 and 5). The other end of the crank 84 is pivotally connected to the piston rod 86 of a vertical adjustment hydraulic cylinder 88. The lower end of this vertical adjustment hydraulic cylinder 88 is connected to a bracket 90 (FIGS. 2, 3 and 5) on the inboard sideplate extension 26 by means of a clevis 92 and pin 94.

Figure 4:
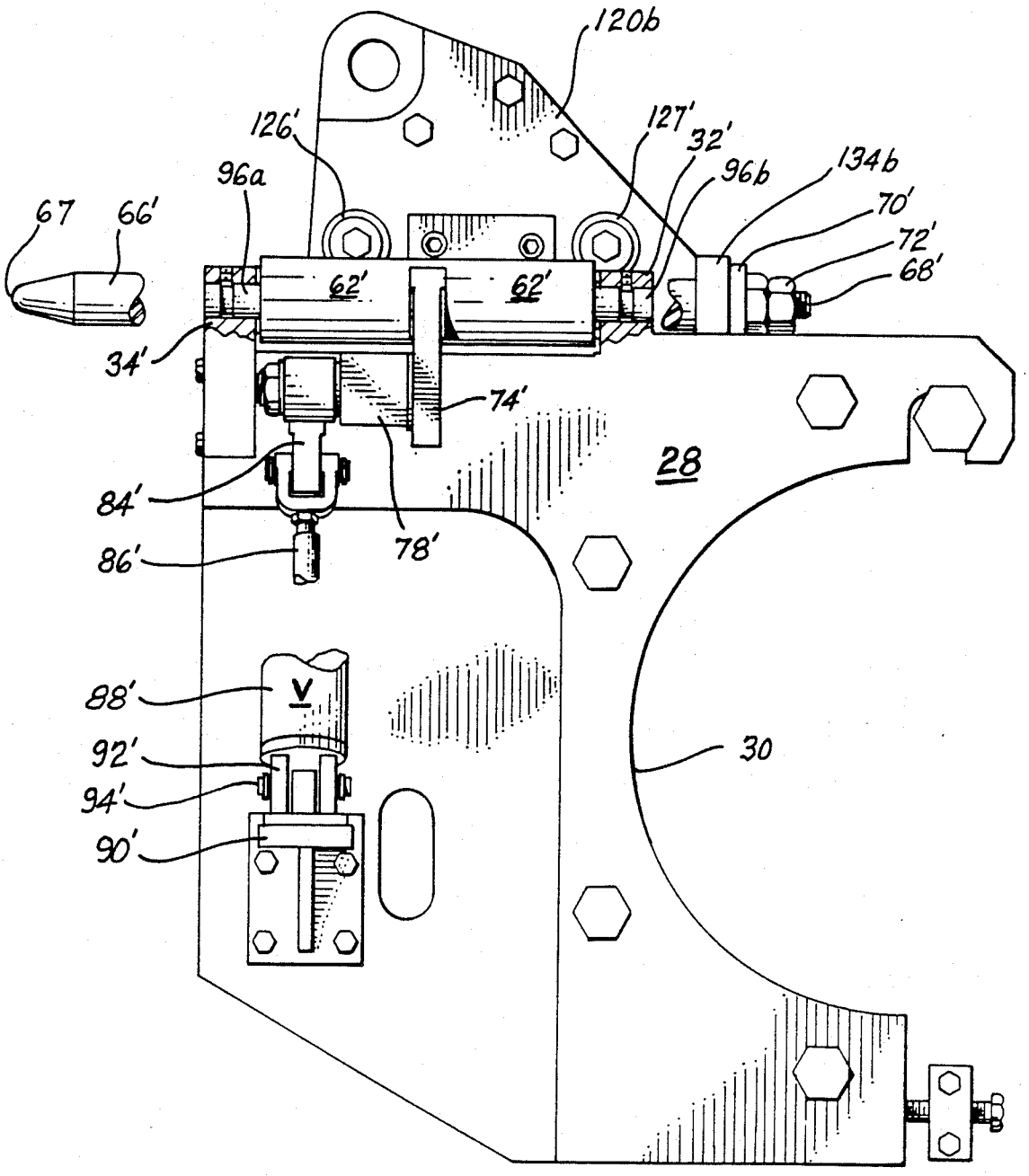
FIG. 4 is a right elevational view ("outboard" side) of the apparatus of FIG. 2.

Many of the elements carried by the inboard sideplate extension 26 are duplicated on the outboard sideplate extension 28. Where this occurs, they are given identical numbers but with a prime (') attached. Thus, outboard sideplate extension 28 carries bracket 90' and block 78'. A vertical hydraulic cylinder 88' is connected through a crank 84' to a radius arm 74'. The radius arm 74' is, in turn, connected to a follower cylinder 62' which carries a guide pin 66'. These elements are all identical to, but in the reversed mirror image of, the corresponding elements carried by the inboard sideplate extension 26. The primary difference is that the follower cylinder 62', as viewed in FIG. 4, is mounted solely for rotation within the sleeve bearings of downstream bearing block 32' and upstream bearing block 34' on its integral stub shafts 96*a*, 96*b*. In other words, there are no eccentrics internal of the follower cylinder 62', because all of the lateral adjustment is accomplished by the lateral adjustment eccentrics 58*a* and 58*b* (FIG. 3) on the inboard side of the caster.

The elements thus far described are integral with the continuous caster in that they are mounted on sideplate extensions of the caster frame. The following features form portions of the feed tube and nozzle assembly 12. A nozzle clamp comprises an upper clamp member 98 (FIGS. 2 and 5) which includes a forwardly (downstream) extending clamping jaw 100 which engages a steel upper clamping plate 102 on ceramic nozzle 14. This molten metal infeed nozzle is shown in dash and dotted outline in FIG. 2, for clearly distinguishing from the locating and guiding apparatus for the nozzle. A somewhat box-like lower clamping member 104 (FIG. 5) includes spaced sidewalls 106*a*, 106*b* which define a nozzle opening 108 therebetween for holding the nozzle 14. A lower clamping jaw (not shown) opposite upper clamping jaw 100 engages a lower clamping plate 110 on the nozzle 14, being supported by the lower clamping member 104.

Lower clamp member 104 is secured to upper clamp member 98 by means of columns 112*a*, 112*b* (FIG. 5) which extend through the upper clamp member. The upper ends of the columns 112*a*, 112*b* are of smaller diameter and are threaded. They are engaged by nuts 114 which, together with washers 116 and helical springs 118 provide a resilient predetermined clamping force on the nozzle 14, regardless of thermal expansion of the nozzle.

Secured to the upper clamp member 98 are a left side plate 120*a* and a right side plate 120*b*. Extending outwardly from each of these side plates is an upper stub shaft 122*a*, 122*b* and a lower stub shaft 124*a*, 124*b*. Mounted on the stub shafts 122*a*, 124*a* of the left side plate 120*a* are an upper flanged guide roller 126 and a lower flanged guide roller 128. Seen in FIG. 5 are the upstream pair of flanged rollers which are positioned to engage the guide pin 66. A similar pair of flanged rollers is located behind and downstream of the pair shown in FIG. 5 as will be understood from FIGS. 2 and 3. The upper flanged roller 127 of this downstream flanged pair can be seen in FIGS. 2 and 3. A similar upstream-pair and downstream-pair roller arrangement is carried by the right (outboard) side plate 120*b* except that the upper roller 130 and lower roller 132 of each opposed pair is cylindrical, rather than being flanged, because all of the lateral adjustment drive is accomplished via the inboard flanged rollers. Also carried by each of the left (inboard) and right (outboard) side plates 120*a*, 120*b* is a respective nozle stop 134*a*, 134*b* (FIGS. 2, 3 and 4) in the form of a rectangular block having a central countersunk truncated conical opening or funnel mouth 136 with this countersink funnel mouth facing downstream, as will be seen in FIG. 3.

Operation

The tundish 10, together with the feed tube and nozzle assembly 12 are moved toward the caster. First the funnel openings in the nozzle stops 134*a*, 134*b*, and then the roller pairs on both sides of the nozzle assembly, engage the elongated guide pins 66, 66'. This engagement may take place, for example, approximately 16 inches (41 centimeters) before the final position of the nozzle is reached. As engagement occurs, the tundish car motion is slowed and the nozzle 14 enters the mold cavity entrance between the upper and lower belts and between the side dams. Tundish car motion is continued until the nozzle stops 134*a*, 134*b* engage the stationary caster stops provided by the conical stops 70. Some force is then continued against the caster while the guide pins are adjusted both vertically (up and down) and horizontally (laterally) to position nozzle 14 to its desired location. The conical stop 70 is rounded for providing line contact and for avoiding taper jamming or wedging.

Both the inboard guide pin 66 and the outboard guide pin 66' are vertically adjusted in the same manner. The vertical adjustment hydraulic cylinder 88 (for vertical adjustment "V") is actuated to rotate the crank 84 in the desired direction. This, crank 84 turns the vertical adjustment shaft 80 (FIG. 7). As will be clear from FIG. 7, turning motion of the shaft 80 causes the eccentric 82 to be turned upwardly or downwardly (arrow 140) within the slot 76 of the radius arm 74. This eccentric turning movement causes the follower cylinder 62 to rotate about its central axis "B", lifting or lowering (arrows 142) the guide pin 66 to the desired vertical elevational location.

Figure 6:
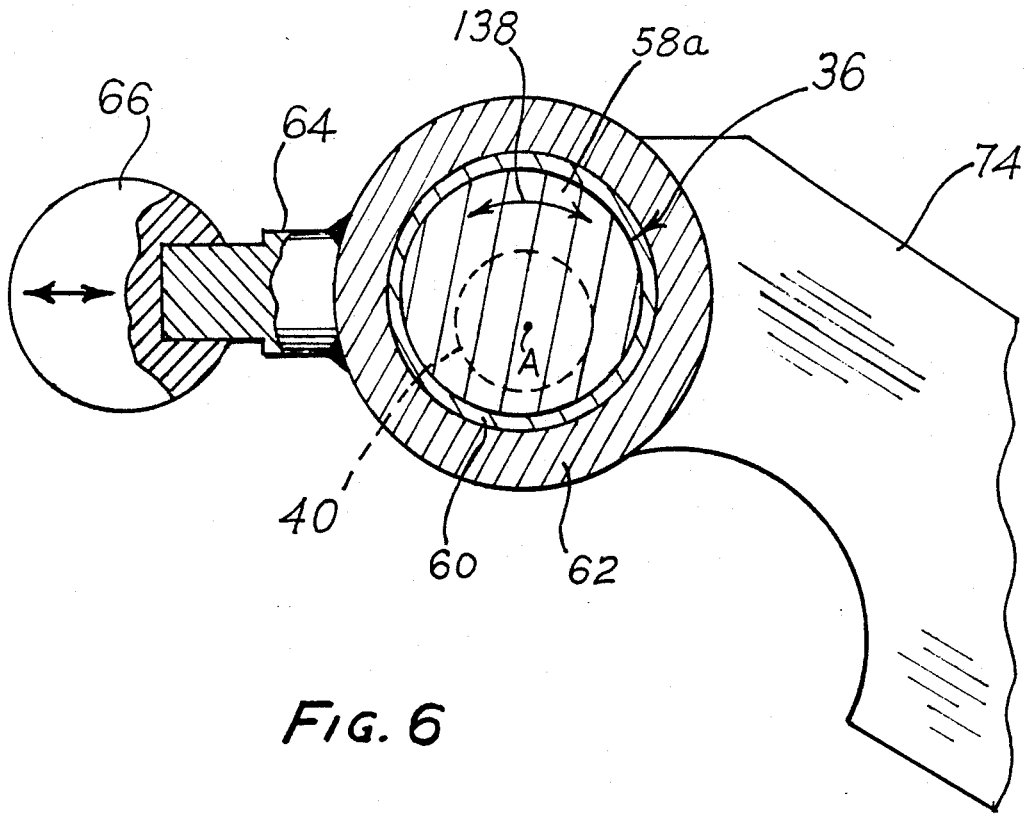
FIG. 6 is an enlarged cross-section taken substantially along the line 6—6 of FIG. 3.

Horizontal (lateral) adjustment of the guide pins 66, 66' is achieved solely from the inboard side of the caster. With particular reference to FIGS. 3 and 6, it will be noted that actuation of hydraulic cylinder 50 (for horizontal adjustment "H") will cause rotation of crank arm 42 which is keyed to eccentric shaft 36. This shaft rotates about an axis "A" (FIG. 6) concentric with its upstream end 40 and downstream end 38 journaled by the stationary downstream and upstream bearing blocks 32 and 34, respectively. As the shaft 36 turns about its axis "A", the eccentric portions, 58*a*, 58*b* are caused to roll right or left (arrow 138) within the sleeve bearing 60 as seen in FIG. 6. This lateral motion 138, in turn, shifts the follower cylinder 62 to the left or right, carrying with it the associated guide pin 66.

Turning now to FIG. 5, it will be noted that the inboard guide pin 66 is engaged by a pair of flanged rollers 126, 128. It is also so engaged by the pair (only flanged roller 127 is seen) located behind, or downstream, of the roller pair 126, 128. Accordingly, horizontal (lateral) movement of this guide pin 66 carries with it the two pairs of flanged rollers and thereby moves the entire nozzle assembly horizontally (laterally). On the outboard side, the guide pin 66' is engaged by cylindrical (non-flanged) roller pairs 130, 132. Accordingly, these non-flanged roller pairs are capable of being slid horizontally (laterally) across the guide pin 66'. This cooperative action of flanged and non-flanged rollers with the guide pins 66 and 66' results in equal horizontal (lateral) displacement of both sides of the nozzle assembly.

It is to be noted that the guide pins 66 and 66' are both inclined downwardly in the downstream direction 23 (FIG. 1) at exactly the same downstream inclination as the twin-belt continuous caster 16, for example about 6° to the plane of the horizon. Therefore, when these guide pins 66, 66' are described as being adjusted "vertically" or are described as having "vertical" adjustment, it is to be understood that terms such as "vertical", "vertically" or "upwardly", "downwardly" as applied to the adjustments of these guide pins are intended to mean generally upwardly and downwardly in directions perpendicular to the inclined plane 23 of the moving mold caster cavity 21. Such upward and downward adjustment may include arcuate travel, the principal component of such arcuate travel being in directions generally perpendicular to the plane 23 of the moving mold casting cavity 21.

The terms "horizontal", "horizontally", "lateral" or "laterally" as applied to the adjustments of these guide pins 66, 66' are intended to describe adjustments in directions generally perpendicular to the downstream direction 23 and toward and away from the inboard side of the caster 16.

It is believed that the many advantages of this invention will now be apparent to those skilled in the art. It will also be apparent that a number of variations and modifications may be made in the present illustrative embodiment without departing from the spirit and scope of the invention. Accordingly, the foregoing description is to be taken as illustrative only, rather than limiting. This invention is limited only by the scope of the following claims and equivalents of the claimed elements.

We claim:

1. In the method of aligning a nozzle for feeding molten metal supplied from a tundish to the input end of a twin-belt continuous caster having travelling upper and lower casting belts and a pair of spaced travelling edge dams to establish accurately the vertical clearance between the nozzle and each of said belts and the horizontal clearance between the nozzle and each of said edge dams, the improvement which comprises:

providing a pair of spaced female guide members;

providing a pair of spaced male guide members alignable with said female guide members;

mounting one pair of said guide members on said nozzle;

mounting the other pair of said guide members on said caster;

adjustably vertically positioning each guide member of the pair mounted on said caster to a desired position relative to said input end;

adjustably horizontally positioning at least one guide member of the pair mounted on said caster to a desired position relative to said input end; and advancing said nozzle toward said caster for engaging said male and female guide members with each other, whereby engagement of said male and female guide members establishes the vertical and horizontal clearances at desired values.

2. The improvement of claim 1 wherein each of said male guide members compfrises a substantially cylindrical pin having a central axis and wherein said vertical positioning step comprises rotating each of said male guide members about an axis of rotation removed from, but parallel to, its central axis.

3. The improvement of claim 2 wherein said horizontal positioning step comprises horizontally translating an axis of rotation of at least one of said male guide members to an adjusted location parallel to its original location.

4. Apparatus for aligning a nozzle employed for feeding molten metal from a tundish to the input end of a twin-belt continuous caster of the type having travelling upper and lower casting belts and a pair of spaced travelling edge dams thereby to establish accurately the vertical clearance between the nozzle and each of said belts and the horizontal clearance between the nozzle and each of said edge dams, which comprises:

at least one female guide member mounted upon one of said nozzle and caster;

at least one male guide member mounted upon the other of said nozzle and caster and alignable with said female guide member;

means for adjustably vertically positioning each guide member mounted on said caster to a desired position relative to said input end; and means for adjustably horizontally positioning at least one guide member mounted on said caster to a desired position relative to said input end;

whereby, upon advancement of said nozzle toward said caster, said male and female guide members will engage with one another and establish the vertical and horizontal clearances at the desired values.

5. The apparatus of claim 4 wherein each of said male guide members comprises a guide pin.

6. The apparatus of claim 5 wherein at least one of said female guide members comprises an opposed pair of rollers arranged to receive a guide pin therebetween.

7. The apparatus of claim 4 comprising first and second spaced female guide members.

8. The apparatus of claim 7 comprising first and second spaced male guide members.

9. The apparatus of claim 8 wherein said first and second male guide members are respectively engageable with said first and second female guide members.

10. The apparatus of claim 9 wherein said first and second male guide members are mounted upon said caster on opposite sides of the input end of the caster and said first and second female guide members are mountedupon said nozzle.

11. The apparatus of claim 10 wherein each of said first and second male guide members comprises a guide pin.

12. The apparatus of claim 11 wherein at least one of said female guide members comprises an opposed pair of rollers arranged to receive a guide pin therebetween.

13. The apparatus of claim 12 wherein at least one of the rollers engaging a horizontally positionable guide pin is flanged so as to be horizontally moveable therewith.

14. The apparatus of claim 13 wherein said adjustably vertically positioning means for each of said first and second guide pins comprises:

a follower cylinder mounted for rotation about its longitudinal rotational axis;

means securing said guide pin to said follower cylinder parallel to, but spaced from, said axis; and means for rotating said follower cylinder about its rotational axis to thereby vertically position said guide pin.

15. The apparatus of claim 14 wherein said rotating means comprises:

a radius arm secured at one end to said follower cylinder, extending radially therefrom, and defining a slot adjacent its other end;

a vertical adjustment pin substantially parallel to said follower cylinder and mounted for rotation about its longitudinal axis;

an eccentric carried by said adjustment pin positioned in said slot;

a crank having a first end connected to said vertical adjustment pin and a second end; and means connected to the second end of said crank for rotating the crank, adjustment pin, and eccentric to thereby displace said radius arm and rotate said follower cylinder.

16. The apparatus of claim 15 wherein the means connected to the second end of the crank comprises a hydraulic cylinder and piston.

17. The apparatus of claim 14 wherein said horizontal positioning means comprises means for horizontally displacing the rotational axis of said follower cylinder.

18. The apparatus of claim 17 wherein said horizontal displacing means comprises:

an elongated eccentric shaft rotatable about its longitudinal axis and extending through said follower cylinder;

a circular eccentric portion on said eccentric shaft having its central axis coincident with the rotational axis of said follower cylinder and displaced from the longitudinal axis of the eccentric shaft;

bearing means for mounting said follower cylinder for rotation about said eccentric portion and central axis; and means for rotating said eccentric shaft about its longitudinal axis to thereby horizontally displace the rotational axis of said follower cylinder.

19. The apparatus of claim 18 wherein said eccentric shaft rotating means comprises:

a crank arm having a first end connected to said eccentric shaft and a second end; and a hydraulic cylinder and piston connected to the second end of said crank arm.

20. The apparatus of claim 19 wherein:

said first and second guide pins are mounted on opposite sides of said casting belts and edge dams;

said horizontal positioning means is associated only with said first guide pin;

the flanged roller of said one female guide member engages said first guide pin; and the rollers of the other female guide member are substantially cylindrical to slide horizontally across the surface of the second guide pin upon operation of the horizontal positioning means.

21. The apparatus of claim 18 wherein:

said first and second guide pins are mounted on opposite sides of said casting belts and edge dams;

said horizontal positioning means is associated only with said first guide pin;

the flanged roller of said one female guide member engages said first guide pin; and the rollers of the other female guide member are substantially cylindrical to slide horizontally across the surface of the second guide pin upon operation of the horizontal positioning means.

* * * * *